United States Patent [19]

Jung

[11] Patent Number: 4,882,043

[45] Date of Patent: Nov. 21, 1989

[54] COMBINATION ROLL-TYPE MAGNETIC AND ELECTROSTATIC SEPARATOR AND METHOD

[76] Inventor: Lothar Jung, 1355 Plymouth Rd., Bridgewater, N.J. 08807

[21] Appl. No.: 1,384

[22] Filed: Jan. 8, 1987

[51] Int. Cl.[4] ..... B03C 1/02

[52] U.S. Cl. ..... 209/212; 209/231; 209/130; 209/12

[58] Field of Search ..... 209/12, 127.1, 127.2, 209/129, 130, 212, 214, 219, 220, 231

[56] References Cited

U.S. PATENT DOCUMENTS

| | | | |
|---|---|---|---|
| 411,899 | 10/1889 | Moffatt | 209/212 |
| 676,841 | 6/1901 | Edison | 209/231 |
| 994,870 | 6/1911 | Payne | 209/130 |
| 1,116,951 | 11/1914 | Sutton et al. | 209/127.2 |
| 1,962,358 | 6/1934 | Orvis | 209/231 |
| 2,180,804 | 11/1939 | Fahrenwald et al. | 209/127.2 |
| 3,439,808 | 4/1969 | Sommermeyer | 209/219 |

*Primary Examiner*—Joseph F. Peters, Jr.
*Assistant Examiner*—Edwin L. Swinehart
*Attorney, Agent, or Firm*—Lorusso & Loud

[57] ABSTRACT

The disclosed invention provides method and apparatus for the separation of diamagnetic and paramagnetic particulate material. The invention utilizes a magnetic roll formed of either alternating permanent magnet and nonmagnetic spacer disc elements or alternating saperdisc elements and disc elements in which magnetism is induced. The dry admixture to be separated into magnetically homogeneous fractions is fed as a plurality of discrete streams onto spaced points on the upper surface of the rotating roll. The feed material undergoes lateral separation on the face of the roll and the materials of different properties part from the surface of the roll at different angular positions, thereby enabling their separate collection. For this purpose a plurality of receptacles are provided in a horizontally spaced relationship to collect the individual streams of diamagnetic material as they leave the surface of the rotating roll. In the preferred embodiments the streams of diamagnetic material off of the last roll pass through a high voltage field whereby they undergo an electrostatic separation.

22 Claims, 3 Drawing Sheets

COMBINATION ROLL-TYPE MAGNETIC AND ELECTROSTATIC SEPARATOR AND METHOD

BACKGROUND OF THE INVENTION

1. Field of the Invention

This invention relates to dry separators of the roll type capable of the separation of feebly magnetic granular materials, which materials also have small differences in their dielectric susceptibility and which may be either paramagnetic or diamagnetic in nature, for the purpose of isolating specific material from an heterogeneous batch.

2. The Prior Art

In the prior art pertaining to magnetic separation, a variety of separators, including roll separators, have been described for the foregoing purpose. It has been demonstrated that for the best separations of similar materials, a high background magnetic field and high field gradients are required. Prior art apparatus having such features has been designed for both dry and wet media.

Two basic types of roll separators represent the prior art:

a. The induced roll separator utilizing a magnetic field developed by an electric current and b. The Perm Roll separator in which the field is provided by strong permanent magnets.

In both systems the rolls are constructed in such a manner that high magnetic gradients are developed on their respective surfaces. In the case of induced roll separators this is often accomplished in the prior art by in-laying of nonmagnetic material (such as copper wire) into the ferromagnetic surface of the rolls.

In the case of the perm roll separator, the actual roll is formed of a plurality of permanently magnetized annular discs which are assembled on a shaft through their central holes. For the maximum performance of the rolls, the individual magnetic discs are arranged so that only identical magnetic poles such as north and south are facing each other across a "gap" provided by a magnetically soft material comprising a higher magnetic permeability.

Furthermore, in order to keep magnetic materials from building up on a permanent magnetic roll, the state of the art separators comprise a revolving belt wrapped around that roll and an idler roll, which is always detrimental to the performance of the rolls, even with the least interfering belts.

The prior art machines of the above types all comprise feeder devices for the granular materials that are designed to provide variable, but uniform (constant weight per inch of roll) loading of the rolls. I have discovered that this principle is primarily responsible for the necessity for multiple passes of the material over the rolls, because the rolls are often over or underfed, causing particle masking or undesirable particle trajectories to develop and most importantly, a large portion of the feed material is introduced to those sections of the rolls having both the lower field and gradient magnetic product.

The prior art separators of the above types also incorporate a splitter system, most commonly a wedge, which can never be properly placed for all fractions contained in the feed, even though it is known that the roll will act as a particle size classifier in addition to its magnetic effects, resulting often in waste of good material owing solely to its size, rather than its magnetic properties.

Yet another disadvantage of the prior art equipment derives from the use of vibratory feeders for the initial feeding of the first roll in multi-stage roll separators. In particular the feeding of dielectric minerals having high resistivities leads to the build-up of electric charges on the particles prior to their entering the high field/high gradient areas of the magnets, which charges compete and interfere with the magnetic forces to be developed, resulting in indiscriminate separation conditions.

In the prior art of electrostatic or electrodynamic separation, a variety of separation equipment including roll separators and free-fall separators, have been described for the separation of granular materials which have small differences in their dielectric properties.

Compared to magnetic separation techniques, contamination-free electrostatic separation is significantly more complex in nature and if not impossible to realize. In the prior art electrostatic roll separator, vibratory fed and thereby charged particulate matter is deposited onto a rotating grounded metal drum. Non-conductors will adhere to the rotating drum due to image charges developed on the drum while conductors lose their charges rapidly and are spun off by centrifugal forces. Particles being more conductive than others will also be deflected off the rotating drum when entering the electric field of a suitably spaced away electrode, generally being negatively charged, while the non-conductors continue to cling to the drum and must be brushed off. In the case of the non-conductors being the product, such as in the instance of high purity quartz, contamination is inevitable. The same holds true for yet another variation of the prior art separator, the electrodynamic type roll, where the electric charges are provided by a corona field, with all other apparatus features remaining the same.

Yet another type of prior art electrostatic separator, the free-fall type, is a bulky apparatus comprising dozens of feet in height. Extremely high operating voltages (up to 250 Kilovolts) are used for the separation of granular materials with such conventional bulky splitter systems to produce the required deflections of several inches, sometimes feet. Repeated heating of the feed material becomes then mandatory because of the multiple pass requirement for better separation. High temperature is unsuitable for magnetic separation due to the loss of magnetic properties of both the feed and the magnets. Hence magnetic and electrostatic separations have not been combined in prior art apparatus or into a single step in conventional methods.

SUMMARY OF THE INVENTION

Accordingly, it is an object of the present invention to provide a method and apparatus for the separation of paramagnetic particulates from diamagnetic particulates.

It is another object of the present invention to provide a method and apparatus for splitting diamagnetic particulates on the basis of small differences in their dielectric properties.

Yet another object of the present invention is to dispense with the need for the use of a cleaning belt in conjunction with a roller-type magnetic separator.

Other objects and further scope of applicability of the present invention will become apparent to those skilled in the art from a reading of the detailed description to follow, taken in conjunction with the accompanying drawings.

Accordingly, the present invention provides a method and apparatus for separating a dry admixture of different diamagnetic and paramagnetic particulate materials. The apparatus includes a roll formed of a plurality of disc-shaped magnetic elements and a plurality of disc-shaped, soft magnetic spacer elements. The spacer elements and magnet elements are arranged in an alternating sequence on a common shaft in an abutting relationship. The apparatus further includes a drive motor for rotating the roll and a novel reservoir for feeding the particulate admixture as a plurality of discrete streams onto the rotating surface of the roll. Toward this end, the feed reservoir is provided with a plurality of apertures which are juxtapositioned with respect to the spacer elements, in the preferred embodiments. First and second collectors are provided with the apparatus for the separate collection of the diamagnetic particles and the paramagnetic particles.

In one preferred embodiment the collector for the diamagnetic materials includes a plurality of receptacles for the individual collection of each of the bands of diamagnetic material which are spun off of the roll along a tangent with respect to the roll surface. These individual receptacles may be in the form of tubes. If desired, provision may be made for the further separation of the collected diamagnetic materials, with the tubes feeding the collected diamagnetic materials as separate streams onto the surface of a second roll similar to the roll described above.

In a preferred embodiment electrodes are provided which extend along the width of the streams of the diamagnetic material which have been spun off from the surface of the roll and are in transit to the collector. These electrodes are so positioned that a fraction of the streams, consisting mainly of more conductive diamagnetic particles, is diverted toward the negative electrode and onto the second collector. If desired, an insulating shield may be positioned between the negative electrode and the roll to prevent the combination of the paramagnetic and the diamagnetic fractions.

In accordance with the method of the present invention, the aforementioned admixture of diamagnetic and paramagnetic particulate materials is fed as a plurality of discrete streams onto the top surface of the rotating magnetic type roll whereby the admixture separates laterally on the face of the roll to form alternating bands of paramagnetic particulate material and bands of diamagnetic material. Given the fact that the diamagnetic material will spin off of the roll surface along a tangent thereto, while the paramagnetic material will follow the roll longer, the diamagnetic material and the paramagnetic material may be separately collected.

In the preferred embodiments the streams of the admixture are fed onto the spacer elements.

In another preferred embodiment the streams of diamagnetic material leaving the drum's surface are passed through a voltage field whereby a portion of the diamagnetic particle streams is deflected and collected either separate or along with the other discarded particulates (principally a paramagnetic material).

DESCRIPTION OF THE PREFERRED EMBODIMENTS

Figure 1:
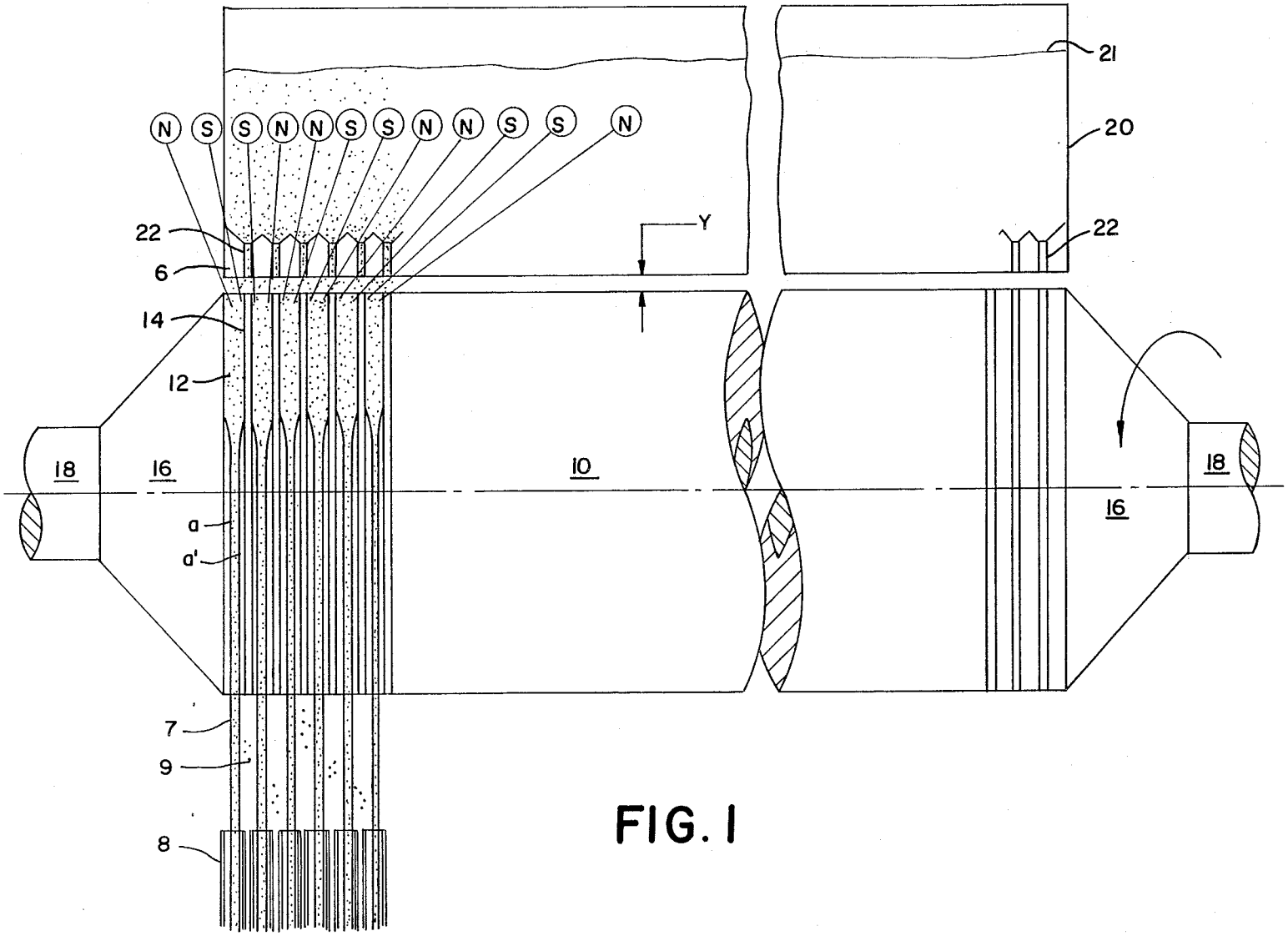
FIG. 1 is a schematic illustration presenting an elevational view of one embodiment of the apparatus of the present invention.

A permanent magnet roll 10 is shown in FIG. 1 as including a plurality of axially mounted magnetic discs 12, which may be composed of a samarium-cobalt alloy or of a Neodynium-Iron-Boron alloy produced by sintered powder technology, and a plurality of spacer discs 14 cut or stamped out from sheet metal having high magnetic permeability. To this extent (only), the permanent magnetic roll 10 of the present invention conforms to the best arrangement of the prior art, namely the "bucking mode" assembly (opposing poles arrangement) alluded to above. The permanent magnet elements 12 and spacers 14 are of the types conventionally used in roll type magnetic separators. Most preferred at present is a 4" diameter roll with permanent magnetic discs 4 mm thick and spacers 1 mm in thickness. In the presently preferred method such a roll is rotated at about 105 rpm, as I have discovered that, at the maximum feed rate (maximum loading for effective separation), the roll speed itself is important, i.e. about 105 rpm for a 4" diameter roll.

In examining this particular roll assembly, I discovered that the highest field/gradient product is near the peripheral edges of each magnetic disc, i.e. across the spacer, regardless of polarity and that it is the lowest in the middle of the periphery of each magnet.

Accordingly, the present invention includes a feeder 20 having a plurality of horizontally spaced, calibrated feed holes 22 over each such maximum field/gradient area of the roll. In other words, the apertures or feed holes 22 are individually juxtapositioned with respect to the spacers 14 across a gap "Y". "Y" will typically be of a width no greater than 1X the diameter of a hole 22. Each hole 22 is formed in a block 23 in communication with a cone 25, or alternately, a V-shaped trough defined by side walls cut into the block 23 at an angle steeper than the angle of repose of the material to be fed. Now, in maintaining a constant head for the feed, a constant feed rate is achieved, thereby avoiding over or underfeeding and at the same time maintaining the maximum load the roll can tolerate. In order to monitor the level 21 of particulates in feeder reservoir 20, reservoir 20 is preferably formed with transparent side walls 19. With proper speed of rotation of the roll, mono-layered loading and thereby maximum exposure to the strongest portions of that roll can be maintained. By simply stopping the rotation of the roll, the flow of granular material of the particulate feed is stopped due to its angle of repose, without the use of shutters, gates or valves.

In a further deviation from the prior art the belt has been eliminated from the permanent magnet roll apparatus in order to allow the granular material access to the maximum magnetic forces, which are extremely shallow. Prior to entering the reservoir 20 all ferromagnetic particulate matter is removed from the feed material in a conventional manner such as by use of a lower strength scavenger roll of conventional design.

In yet another deviation of the prior art, conical end pieces 16 which are tapered down from the endmost magnet 12 to the shaft 18 are provided to facilitate the occasional cleaning of the roll. Cleaning may be accomplished by lateral movement of adhering particles and moving them away from the magnets in a direction parallel to the length of the shaft.

While permanent magnets are presently preferred for use as the magnet elements 12, elements in which magnetism is induced also serve effectively in the present invention.

The feebly magnetic feed material preferably of a closely sized fraction at any time, undergoes a lateral separation while on the roll surface with all diamagnetic matter moving to the middle of each magnet and with a concentration of the paramagnetic and occasional ferromagnetic particles at the edges of each magnet 12 adjacent the spacer disc 14.

In the case of a predominantly diamagnetic feed such as quartz or feldspar, the diamagnetic material will form into narrow bands having boundaries a, $a^1$ as shown in FIG. 1 and will exit the roll as flat narrow streams, while the other matter 26, principally a paramagnetic material, will stay behind or be laterally separated from it.

This forward and lateral separation can be utilized to collect a magnetically homogenous material from the feed admixture by using a novel splitter 30 which includes an array of tubes 32 appropriately horizontally spaced to individually collect the emerging streams 24. The diamagnetic particle streams will spin off the roll 10 along a path which is approximately tangential to roll 10 due to centrifugal force. The angle $\gamma$, between that path and the vertical will vary with particle size and roll speed. Paramagnetic particles 26 will follow the roll surface longer and ferromagnetic particles 28 will cling to the roll.

In accordance with the objective of this invention all materials, other than the diamagnetic material 24, are rejected and the homogeneity of the separated diamagnetic product is greatly improved as compared with the feed to the roll 10.

Figure 2:
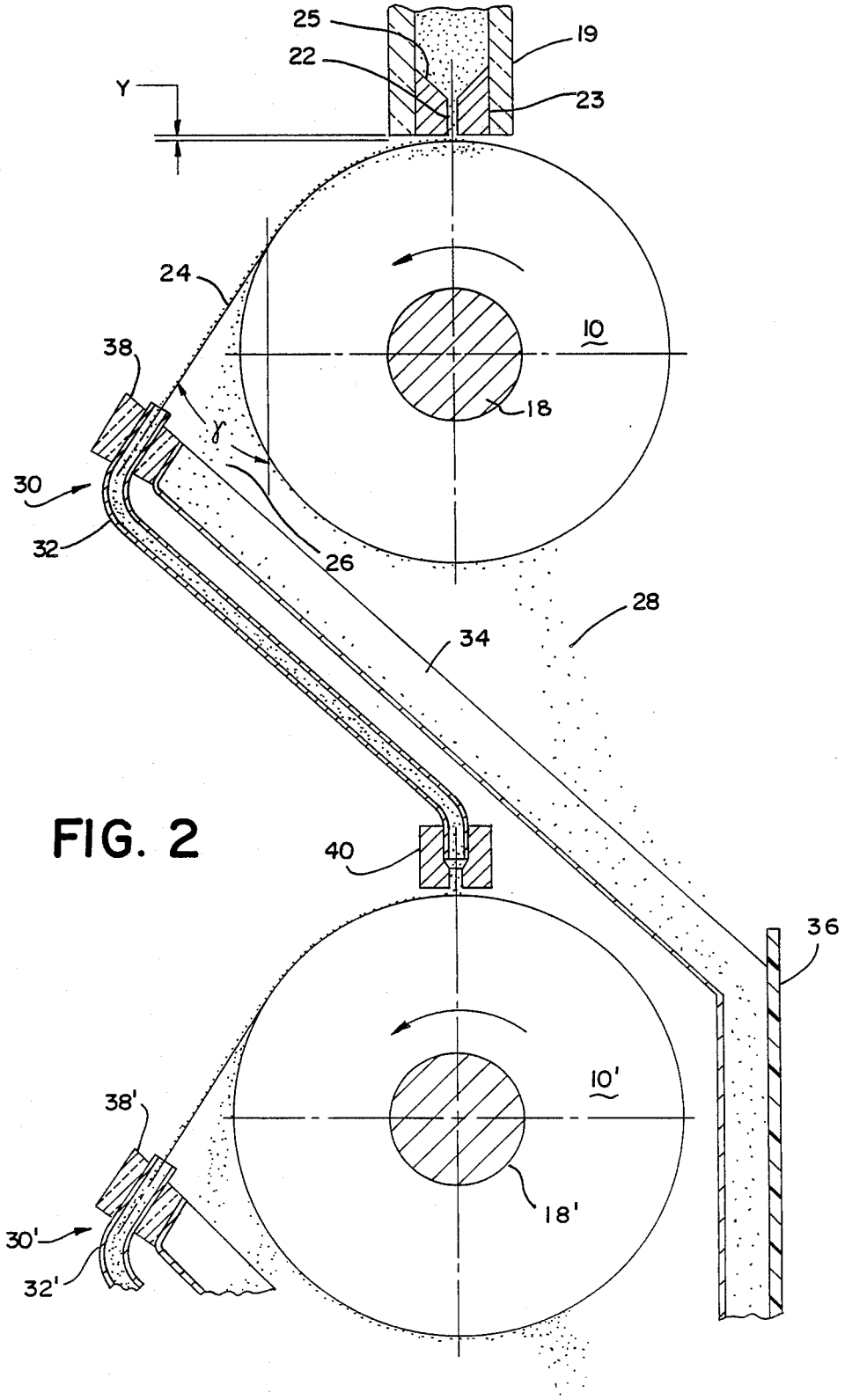
FIG. 2 is a schematic elevational view showing the apparatus of the present invention in cross-section and the flows of the various types of particulate material.

FIG. 2 illustrates a side view of the feeder roll separator 10 and tubular splitter system 30. The rejected paramagnetic materials 26 are collected on a tray 34 and diverted to a waste system shielded by a gate 36.

The array of tubes 32 have first ends mounted in a spacer block 38 and are bent to divert the isolated diamagnetic material collected off roll 10 onto another high field/high gradient roll 10' below, through gravitational forces, using the same principle of feeding/separation as described above. The ends of tubes 32 adjacent roll 10' are mounted in a second spacer (insulating) block 40.

The spacer block 40 acts as yet another angle of repose shutter when the roll ceases to rotate, without need for any additional gates, valves or shutters.

This arrangement allows the compact assembly of several separator stages while conforming to the objectives of the invention.

Due to the effective separation of paramagnetic from diamagnetic materials and further the splitting among diamagnetic materials, the present invention is effective, for example, in the separation of certain types of feldspar and other materials from quartz.

In tests, a magnetic separator as described herein successfully separated anorthite, microcline perthite, zircon, biotite, chlorite, tobernite, ilmerite, quartz containing saginite (rutilation), muscovite and many more minerals mixed in with pegmatite quartz such as the ones found in Spruce Pine, North Carolina.

Only in the case of high purity quartz and a high purity plagioclase (Albite) feldspar having nearly identical magnetic susceptibilities, did the feed remain unsplittable.

Figure 3:
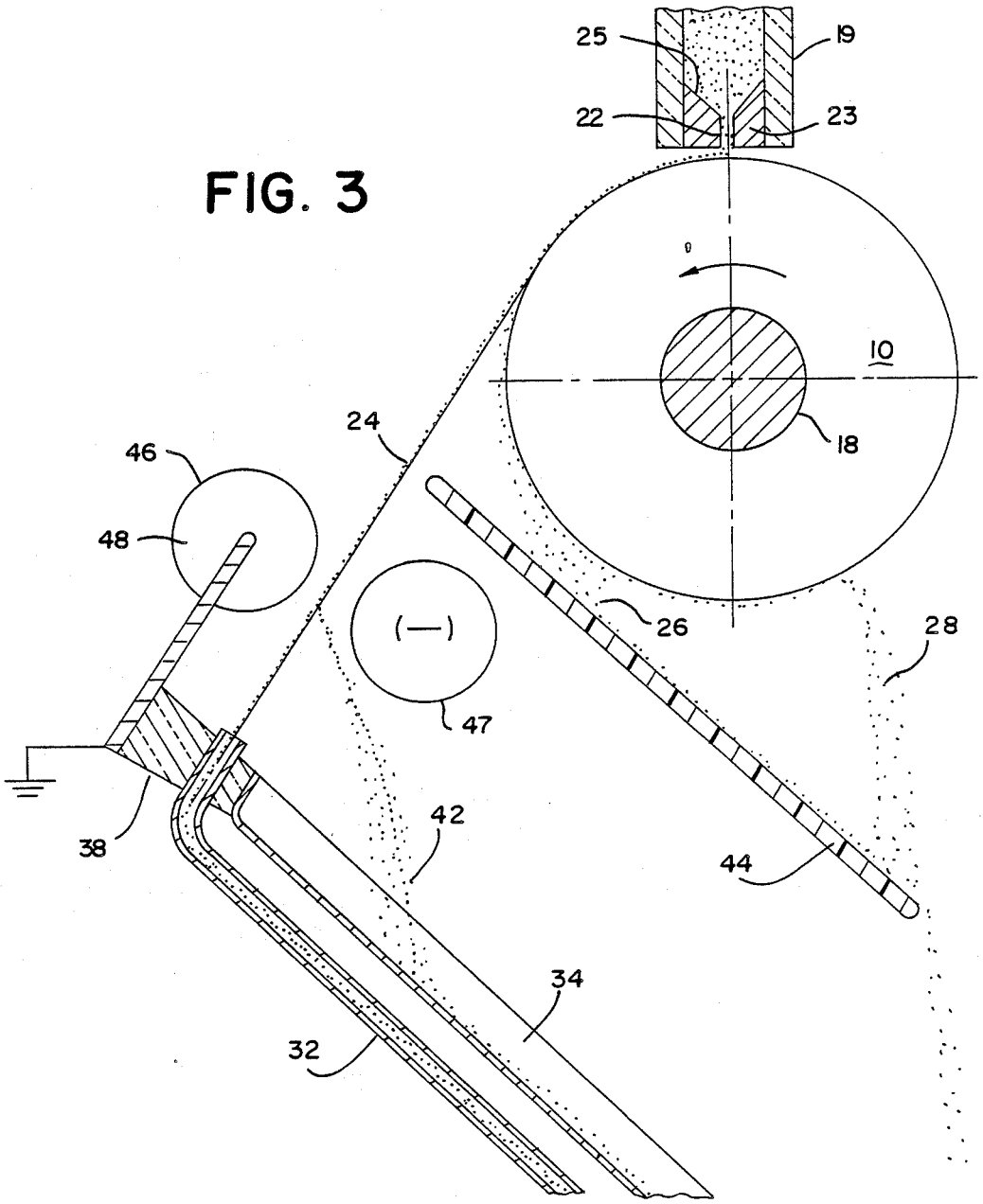
FIG. 3 is similar to FIG. 2 but shows an alternative embodiment of the present invention incorporating a pair of electrodes for separation of yet an additional increment of "impurities" from the diamagnetic material product.

The embodiment illustrated in FIG. 3, in addition to the separation principles discussed above, utilizes small electric charges that the particles receive while being fed onto or through the magnetic separator for additional discrimination.

For this purpose, two electrodes 46 and 47 are added. The electrode 46 is grounded along with magnetic roll 10, the splitter spacer block 38 and the waste material tray 34, while the electrode 47 is connected to a high tension power supply. The diameter of the electrodes and the voltage are suitably selected to prevent the formation of a corona field and/or arcing and the electrode polarity is preferably negative. The gap between electrodes 46–47 will typically be about ½" to 2" with a voltage of 3 to 20K volts.

In the embodiment of FIG. 3, each defined stream of nearly mono-layered material emerging from the magnetic roll enters an electric field established between the two electrodes 46 and 47, causing the material with the greater conductivity 42 to be deflected from the mainstream toward the negatively charged electrode 47. The grounded electrode 46 may be combined with an elongated radiation type heating element 48 powered by a different power supply. The heating, of the particles will further enhance differences in their electric conductivity due to the rapid heating of the monolayered particle stream, and thereby aid the deflection of conductor particles from the nonconductors. This is particularly desirable in the last step where the product stream will undergo no further magnetic separation. As previously noted, heating has a deleterious effect on the magnetic separation. Therefore, electrostatic separation, if accompanied by heating should follow, rather than precede, magnetic separation. A non-flammable plastic shield 44 is provided to increase the break in voltage between the electrode 47 and roll 10.

The minute deflection so produced is sufficient to separate the feldspar from the quartz and both materials, whichever is the predominant material within the feed, can be separately collected either exiting the tubular splitter 30 or on the tray 34.

The embodiment of FIG. 3 overcomes the disadvantages of state of the art electrostatic roll separators that require brushes to remove, and thereby contaminate, the non-conductors, always the product, from the rolls by performing the electrostatic separation in the air and in conjunction with the magnetic separation.

EXAMPLE 1

The starting material was a sample of a minus seventy plus 140 mesh quartz powder recovered from a Spruce Pine, North Carolina Pine Mountain pit, preliminarily separated by flotation and chemically (with hydrofluoric acid) treated. It was sent (fifteen times) over a commercial permanent magnet comprising one four-inch diameter Samarium-Cobalt roll equipped with a stainless steel belt. The feed rate was kept constant for all passes at 77.5 g per inch and minute. The roll speed was 105 rpm±1 rpm.

The cumulative weight losses of these passes amounted to approximately fifty percent while approximately constant losses of 1.8% by weight occurred after the 7th pass. These constant losses were determined to be caused by electrically charged quartz sticking to the stainless steel belt. Experiments with other belt materials, such as Mylar, graphite impregnated Kevlar produced even worse results. The material was next analyzed and now became the feed material for the novel magnetic separation system of the present invention.

In accordance with the objectives of the invention, the stainless steel belt was removed and the material was fed only once over the magnet. The gap "Y" between the bottom of the feed and the top surface of the roll was 3/32" and the feeder apertures had a diameter of 3/32".

The removed material and the new product were then reanalyzed. An additional weight loss of 6.1% by weight had occurred. The purity levels were as follows:

| Element | Removed Material | New Product |
|---|---|---|
| Aluminum | 106% | 100% |
| Calcium | 174% | 100% |
| Iron | 345% | 100% |
| Lithium | 114% | 100% |
| Magnesium | 175% | 100% |
| Manganese | 175% | 100% |
| Sodium | 158% | 100% |
| Titanium | 141% | 100% |

Since the above elements are not found in the magnetic roll except for Iron, a significant purification of the feed, that could otherwise not be improved, had been achieved.

Repeated tests produced similar results.

EXAMPLE 2

Three batches of optical grade fusing quartz powder of minus seventy plus three hundred twenty five (325) mesh size range were prepared from highly transparent rock crystals of different origins, namely Bahia (Brazil), Minas Gerais (Brazil) and the island of Madagascar which are regarded as the purest raw quartz varieties available for the preparation of optical grade fusing quartz powders.

The method of preparation of these materials was to first manually remove all natural crystal surfaces and inspect all lumps using water or index matching oils as immersion liquid to detect and to remove pieces with inclusions visible to the human eye. An additional inspection under ultraviolet light was employed to ascertain that no natural or manmade glasses would enter these batches.

Next the lumps of quartz were heated above the alpha-beta inversion temperature of quartz generally found to be 573° C., and then quenched in high purity deionized or triple distilled water.

The quenched lumps were re-inspected for possible rutilation and then ground to the above grain size using non-contaminating grinding equipment. It is well known that the above material contains only substitutional lattice impurities and some interstitially placed liquids and gases. On very rare occasions rutile goes undetected through the above-described preparation procedure and small amounts of Titanium are found in the analysis. Typical substitutional lattice impurities are aluminum, lithium and hydrogen, sometimes iron. Titanium present in discolored amethyst and rose quartz varieties may also be regarded as a lattice impurity. Occasionally sodium may be in the lattice as a result of excessive heating of the quartz and an ion exchange for hydroxyl ($OH^- \rightleftarrows Na^+$).

The chemical purity of these three feed materials was next determined by suitable conventional means and then they were passed only once over the novel magnetic separation equipment identical to that described in Example 1. The removed material and the new products were examined and their purities were compared.

| ELEMENT | REMOVED MATERIAL Bahia | Minas | Madagascar | NEW PRODUCT |
|---|---|---|---|---|
| Aluminum | 105% | 103% | 105% | 100% |
| Calcium | 282% | 231% | 354% | 100% |
| Iron | 1752% | 2446% | 100% | 100% |
| Lithium | 101% | 100% | 100% | 100% |
| Magnesium | 211% | 208% | 100% | 100% |
| Manganese | 405% | 212% | 240% | 100% |
| Sodium | 194% | 161% | 110% | 100% |
| Titanium | 136% | 135% | 118% | 100% |
| Weight Loss on magnet | 1.7% | 3.0% | 2.2% | |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. Magnetic separation apparatus for separating a dry admixture of diamagnetic and paramagnetic particulate material, said apparatus comprising:

a roll formed of a plurality of disc-shaped magnet elements and a plurality of disc-shaped, non-magnetic spacer elements, said spacer elements and said magnet elements being arranged in an alternating, axially aligned series, said series of disc elements being mounted on a substantially horizontal shaft in an abutting relationship;

means for rotating said roll;

feeding means for distributing said admixture by gravity, as a plurality of substantially evenly spaced streams, onto the top of said roll substantially uniformly along the length of said roll, whereby said admixture in each of said streams separates laterally on the face of said roll to form alternating bands of paramagnetic material and bands of diamagnetic material;

first collecting means including a plurality of horizontally spaced receptacles with each receptacle positioned to collect one of said bands of diamagnetic particles as they leave the rotating surface of said roll; and second collecting means for separately collecting the paramagnetic particles.

2. Magnetic separation apparatus in accordance with claim 1 wherein said feeding means comprises a reservoir for holding said admixture, said reservoir having a bottom portion spaced from said roll to define a gap therebetween and a plurality of horizontally spaced apertures provided in said bottom portion, each of said apertures providing one stream of said admixture onto the rotating surface of said roll.

3. Magnetic separation apparatus in accordance with claim 1 wherein said plural receptacles are tubes.

4. Magnetic separation apparatus in accordance with claim 1 wherein each of said apertures is juxtapositioned with respect to one of said spacer elements.

5. Magnetic separation apparatus in accordance with claim 2 wherein the gap between the bottom of said reservoir and the top surface of said roll is no greater than the diameter of one of said apertures.

6. Separation apparatus in accordance with claim 2 wherein the gap between the bottom of said reservoir and the top surface of said roll is such that flow of the admixture from said reservoir will stop, due to the angle of repose of the particulate material, upon stoppage of rotation of the roll.

7. The apparatus of claim 1 further comprising a second roll formed of a second plurality of disc-shaped magnet elements and a second plurality of disc-shaped, non-magnetic spacer elements, said second spacer elements and said second magnet elements being arranged in a second alternating, axially aligned series, said second series of disc elements being mounted on a second substantially horizontal shaft in an abutting relationship; and wherein each of said receptacles is provided with an aperture for feeding diamagnetic particles received therein onto the rotating surface of said second roll.

8. The apparatus of claim 7 wherein said receptacles are tubes.

9. Separation apparatus in accordance with claim 1 additionally comprising third collecting means and electrode means for establishing a voltage potential across the path of said bands of diamagnetic particles in transit between said roll and said first collecting means to deflect a portion of said diamagnetic particles onto said third collecting means.

10. Separation apparatus in accordance with claim 9 wherein said electrode means comprises negative and positive electrodes positioned on opposite sides of said path.

11. Separation apparatus in accordance with claim 10 wherein said second collecting means is an insulating shield positioned between said negative electrode and said roll.

12. Separation apparatus in accordance with claim 10 additionally comprising means for heating the particulate material passing between said electrodes.

13. Separation apparatus in accordance with claim 1 wherein said magnet elements are permanent magnets.

14. A method for separating a diamagnetic material from a dry admixture of particulate diamagnetic material and paramagnetic material, said method comprising:

providing first and second separator rolls, each having a plurality of disc shaped magnetic elements and a plurality of spacer elements interposed between adjacent magnetic elements;

rotating said rolls;

feeding discrete streams of said admixture onto spaced areas on the surface of said first roll whereby said admixture in each of said streams separates laterally on the face of said first roll to form alternating bands of paramagnetic material and bands of diamagnetic material;

separately collecting each band of said diamagnetic material into separate receptacles and collecting said paramagnetic material separate from said diamagnetic material, as said materials leave the rotating first roll surface.

feeding the material collected in each receptacle as a discrete stream onto spaced areas on the surface of said second roll whereby said admixture in each of said streams separates laterally on the face of said second roll to split into separate bands of diamagnetic material; and separately collecting (1) alternating bands of said diamagnetic material and (2) the remaining diamagnetic material as said materials leave the rotating second roll surface.

15. A method for separating a diamagnetic material from a dry admixture of particulate diamagnetic material and paramagnetic material, said method comprising:

providing a separator roll having a plurality of disc shaped magnetic elements and a plurality of spacer elements interposed between adjacent magnetic elements;

rotating said roll;

feeding discrete streams of said admixture onto spaced areas on the surface of said roll whereby said admixture in each of said streams separates laterally on the face of said roll to form alternating bands of paramagnetic material and bands of diamagnetic material;

separately collecting each band of said diamagnetic material into separate receptacles and collecting said paramagnetic material separate from said diamagnetic material, as said materials leave the rotating roll surface.

16. The method of claim 15 wherein said streams are fed onto the surfaces of said spacer elements.

17. The method of claim 15 wherein said plural receptacles are tubes.

18. A method in accordance with claim 15 further comprising passing the streams of diamagnetic material emanating from the roll's surface through a high voltage field to separate out a portion of the particulate material and collecting the remainder of the diamagnetic material as a product.

19. A method in accordance with claim 18 additionally comprising heating the diamagnetic material prior to or during passage through said high voltage field.

20. A method in accordance with claim 15 wherein the roll is rotated at a speed to give a mono-layer.

21. Magnetic separation apparatus for separating a dry admixture of diamagnetic and paramagnetic particulate material, said apparatus comprising:

a roll formed of a plurality of disc-shaped magnet elements and a plurality of disc-shaped, non-magnetic spacer elements, said spacer elements and said magnet elements being arranged in an alternating, axially aligned series, said series of disc elements being mounted on a substantially horizontal shaft in an abutting relationship;

means for rotating said roll;

a reservoir for holding said admixture, said reservoir having a bottom portion spaced from said roll to define a gap therebetween and wherein the gap between the bottom of said reservoir and the top surface of said roll is such that flow of the admixture from said reservoir will stop, due to the angle of repose of the particulate material, upon stoppage of rotation of the roll; said streams being substantially evenly spaced uniformly along the length of said roll, whereby said admixture in each of said streams separates laterally on the face of said roll to form alternating bands of paramagnetic material and bands of diamagnetic material.

first collecting means for collecting said bands of diamagnetic particles as they leave the rotating surface of said roll; and p1 second collecting means for separately collecting the paramagnetic particles.

22. The apparatus of claim 21 wherein the gap between the bottom of said reservoir and the top surface of said roll is no greater than the diameter of one of said apertures.

* * * * *